US006006757A

United States Patent [19]

Lichtenberg

[11] Patent Number: 6,006,757

[45] Date of Patent: Dec. 28, 1999

[54] CIGARETTE HOLDER

[76] Inventor: Edward Lichtenberg, 2401 Pennsylvania Ave., Apt. 18 B27, Philadelphia, Pa. 19130

[21] Appl. No.: 09/078,702

[22] Filed: May 14, 1998

[51] Int. Cl.[6] ..... A24F 13/02

[52] U.S. Cl. ..... 131/187; 131/191; 131/198.1; 131/198.2; 131/200; 131/201; 131/202; 131/203; 131/205; 131/206; 131/207; 131/210; 131/212.1; 131/212.2; 131/215.1; 131/215.2; 131/215.3; 131/216; 131/330; 131/342

[58] Field of Search ..... 131/187, 191, 131/198.1, 198.2, 200, 201, 202, 203, 205, 206, 207, 210, 212.1, 212.2, 215.1, 215.2, 215.3, 216, 330, 342

[56] References Cited

U.S. PATENT DOCUMENTS

| | | | |
|---|---|---|---|
| 1,578,171 | 3/1926 | Rifkin | 131/215.2 |
| 2,779,340 | 1/1957 | Mansfield | 131/207 |
| 2,783,761 | 3/1957 | French et al. | 131/207 |
| 4,200,114 | 4/1980 | Waite | 131/330 |
| 4,211,244 | 7/1980 | Williams | 131/330 |
| 4,289,149 | 9/1981 | Kyriakou | 131/191 |
| 4,319,590 | 3/1982 | Patarra | 131/202 |
| 4,637,407 | 1/1987 | Bonanno et al. | 131/198.1 |
| 4,685,477 | 8/1987 | Valdez | 131/202 |
| 4,790,332 | 12/1988 | Wallace | 131/215.1 |
| 4,899,766 | 2/1990 | Ross, Jr. | 131/215.2 |
| 4,993,435 | 2/1991 | McCann | 131/215.1 |
| 5,160,518 | 11/1992 | Vega, Jr. | 131/212.1 |
| 5,353,814 | 10/1994 | Martin | 131/215.2 |
| 5,388,595 | 2/1995 | Shafer | 131/215.3 |
| 5,456,269 | 10/1995 | Kollasch | 131/198.1 |
| 5,472,001 | 12/1995 | Nicholson | 131/198.1 |
| 5,495,859 | 3/1996 | Bowen et al. | 131/202 |
| 5,497,791 | 3/1996 | Bowen et al. | 131/202 |
| 5,501,234 | 3/1996 | Hyre | 131/200 |
| 5,529,078 | 6/1996 | Rehder et al. | 131/215.3 |
| 5,540,241 | 7/1996 | Kim | 131/215.1 |
| 5,598,853 | 2/1997 | Hyre | 131/202 |
| 5,638,833 | 6/1997 | Bowen et al. | 131/202 |
| 5,752,527 | 5/1998 | Bowen et al. | 131/202 |

*Primary Examiner*—Stanley S. Silverman
*Assistant Examiner*—Michael P. Colaianni
*Attorney, Agent, or Firm*—Max Goldman

[57] ABSTRACT

A cigarette holder completely encloses the lit end of a cigarette providing purification for both sidestream smoke and mainstream smoke. It has two concentric tubes with the lit cigarette placed in the inner tube and purifying agent placed in the volume between the inner tube and the outer tube. A chimney effect is produced wherein air flows through an air port past the lit cigarette to keep it burning. The sidestream smoke passes through the purifying agent and is discharged into the environment. The filter tip of the lit cigarette extends through a mouthpiece and the smoker exhales smoke through openings in the same mouthpiece. The mainstream smoke passes through the same purifying agent, in a direction opposite to the flow of the sidestream smoke, and is then discharged into the environment.

15 Claims, 4 Drawing Sheets

CIGARETTE HOLDER

BACKGROUND OF THE INVENTION

The invention relates generally to cigarette holders and more specifically to a cigarette holder which filters and purifies both sidestream smoke (from the burning tip of a cigarette) and mainstream smoke (smoke exhaled by the smoker).

Scientific studies have shown that the largest single cause of preventable disease and death in the United States is due to cigarette smoking. The evidence indicates that the chances of a smoker getting lung cancer is approximately 11 times greater than that of the non-smoker, and the chances of a smoker dying from heart disease is approximately 3 times greater than that of a non-smoker. Smoking is therefore the leading cause of premature death in the United States.

In recent years, health authorities have become increasingly concerned with the effects of environmental tobacco smoke (ETS) on non-smokers. Environmental tobacco smoke consists of the smoke exhaled by the smoker (the mainstream smoke) as well as the smoke generated by the burning tip of the cigarette (sidestream smoke). Non-smokers find that environmental tobacco smoke has an unpleasant odor and often causes nasal and throat irritation. In addition, scientific studies have shown that non-smokers exposed to ETS have twice the chance of getting lung cancer as non-smokers not exposed to ETS. Furthermore, studies have shown that second-hand smoke is a cause of atherosclerotic disease. The overall public health impact of ETS is considerable. Of the estimated 280,000 smoking-related deaths that occur each year in the United States, 53,000 have been attributed to ETS making passive smoke the third leading preventable cause of death after active smoking and alcohol use. In addition, the relative risk of cardiovascular disease is considered to be 1.2 to 1.3 for individuals exposed to ETS. Of the deaths caused by ETS, the number of deaths from heart disease is about 3 times the number of non-cardiac deaths.

In addition to health hazards, there are many other unpleasant effects of smoking. The unpleasant odor of tobacco permeates the homes of smokers, imparting unpleasant odors to drapes, furnishings, carpets and the like. Also, the hot ashes from cigarettes cause burns in furniture, rugs, bedding, car upholstery, carpets and clothing. Furthermore, the teeth and the fingers of smokers are often discolored with a brown stain from the tobacco smoke. Tragedies often occur, wherein a smoker falls asleep with a lit cigarette and causes a fire.

Many devices have been disclosed which are intended to combat deleterious health and other effects of cigarette smoking. U.S. Pat. No. 5,495,859 (Bowen, et al.) discloses a device having two sections. The first section has a cigarette holder for holding a lit cigarette with a first filter. The second section has a second filter and a mouthpiece for exhaling smoke. A third central section has a battery and exhaust fan for directing the sidestream out of the device and for supplying sufficient air to keeping the cigarette lit and the device cool. A third filter of activated carbon may be used to remove gaseous elements. The use of an exhaust fan makes the device impractical.

U.S. Pat. No. 4,685,477 (Valdez) discloses a device that has two concentric tubes held apart by two end pieces, with filter material between the tubes to filter sidestream smoke. No provisions are made for the filtration or purification of mainstream smoke. The cigarette is placed inside the inner tube. In this device, holes at the end of the inner tube provide for air intake. It appears that ashes inside the tube will block the air into air-intake holes extinguishing the lit cigarette. It also appears that as the cigarette burns it no longer will be supported by the end piece at the lit end of the cigarette.

U.S. Pat. No. 4,790,332 (Wallace) discloses a pack-sized cigarette holder with two mouthpieces, one for inhaling and the other for exhaling smoke. It comprises a dual filter, one of HEPA for removing particulate matter and the other a polyurethane for removing odor from the smoke. On exhaling through the second mouthpiece, the first mouthpiece is closed by a ball. Exhaling pushes a disc which allows smoke into the body of the device. This device is cumbersome. Furthermore, HEPA requires a considerable pressure to cause a gas to flow through it. This renders the device impractical for exhaling smoke from a cigarette.

U.S. Pat. No. 4,899,766 (Ross, Jr.) discloses a device which encloses a cigarette. A long tube is used with an external filter to filter both the sidestream and mainstream smoke. An exhaust fan is used to direct smoke out of the device. This device is cumbersome and not portable.

U.S. Pat. No. 4,369,798 (Jackson) discloses a cigarette holder body with a mouthpiece. The filter end of the cigarette fits into the body. Exhaled smoke is blown into the mouthpiece and filtered by a filter cartridge. This device does nothing to filter or purify sidestream smoke.

U.S. Pat. No. 5,396,907 (Roja Henao, et al.) discloses a device which includes an ignitor which lights a cigarette when it is placed in a device. A spring-loaded fresh air intake valve allows the air to go to the lighted cigarette. A bellows is used to trap exhausted smoke or a detachable filter can be used, It is not clear how the bellows performs this function or how the entrapped gases are disposed of.

U.S. Pat. No. 4,637,407 (Bonanno, et al.) discloses a device which uses a power source to maintain an air flow to the lit portion of the cigarette and to drive the exhaled smoke through a filter. The motor driven air impeller can be stopped to extinguish the cigarette. This device does not filter mainstream (exhaled smoke) at all.

There is a need for a small, light, convenient to use cigarette holder which effectively filters and purifies both mainstream and sidestream smoke without the use of a power sources, as described below.

OBJECTS OF THE INVENTION

Accordingly, it is the general object of the instant invention to provide a cigarette holder which improves upon and overcomes the shortcomings of present devices.

It is a further object of the instant invention to provide a cigarette holder which purifies both sidestream smoke flowing in one direction through a purifying agent and mainstream smoke flowing in the other direction through the same purifying agent.

It is yet a further object of the instant invention to provide a cigarette holder which does not require a power source or forced air and which supplies ample quantities of air to the lit cigarette to maintain combustion.

It is still yet a further object of the instant invention to provide a cigarette holder with a uniquely designed mouthpiece which permits normal inhaling, using the filter of a cigarette and which provides means for exhaling through a purifying agent before discharging the smoke into the environment.

It is another object of the instant invention to provide a cigarette holder with means for allowing the sidestream smoke to flow through the purifying agent before discharging it into the environment.

It is yet another object of the instant invention to provide a cigarette holder which permits lighting the cigarette and inserting it into the holder with minimal discharge of unpurified smoke into the environment.

It is still another object of the instant invention to provide a cigarette holder with a simple means for ash removal.

It is still yet another object of the instant invention to provide a cigarette holder with a simple means to replace used purifying agents.

It is still further another object of the instant invention to provide a cigarette holder which permits a large amount of purifying agent to be used and yet it is light in weight.

It is an additional object of the instant invention to provide a cigarette holder which eliminates the possibility of fires, burns, damage to clothing, furniture, rugs and the like.

It is yet an additional object of the instant invention to provide a cigarette holder which eliminates lingering household and clothing odors.

It is still an additional object of the instant invention to provide a cigarette holder which eliminates discoloring of the fingers of the smoker.

It is still yet an additional object of the instant invention to provide a cigarette holder which withstands the heat of a lit cigarette and which is warm to the touch.

It is a further additional object of the instant invention to provide a cigarette holder which is small, light, simple and inexpensive to manufacture.

SUMMARY OF THE INVENTION

These and other objects of the instant invention are achieved by providing a cigarette holder with means for passing, without mechanical means or a power source, sidestream smoke through a purifying agent in one direction and for passing mainstream smoke through the same purifying agent in the other direction. The holder has two concentric tubes, with a purifying agent placed in the volume between the tubes. A single mouthpiece holds the cigarette through a center hole from which the filter end of the cigarette protrudes and has at least one opening through which the mainstream cigarette smoke is exhaled. The mouthpiece is removable for dispensing cigarette ashes which have collected in the holder. At the end of the tubes opposite the mouthpiece is a filter cap which is removable for placing the purifying agent into the volume between the tubes and for replacing the purifying agent when it is spent. Slots in the inner tube allow sidestream smoke to pass into the outer tube and to flow through the purifying agent. The outer tube has slots for passing the mainstream smoke from the purifying agent to the atmosphere.

DESCRIPTION OF THE DRAWINGS

Other objects and many of the intended advantages of this invention will be readily appreciated when the same becomes better understood by reference to the following detailed description, when considered in connection with the accompanied drawings wherein.

DETAILED DESCRIPTION OF THE PREFERRED EMBODIMENT

Figure 1:
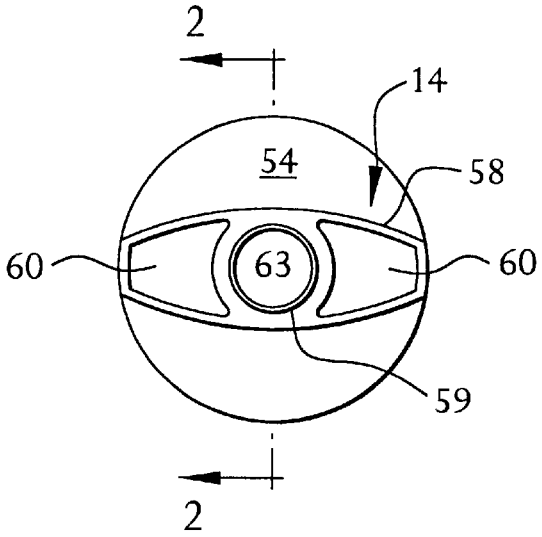
FIG. 1 is a view of the mouthpiece end of the cigarette holder.
Figure 2A:
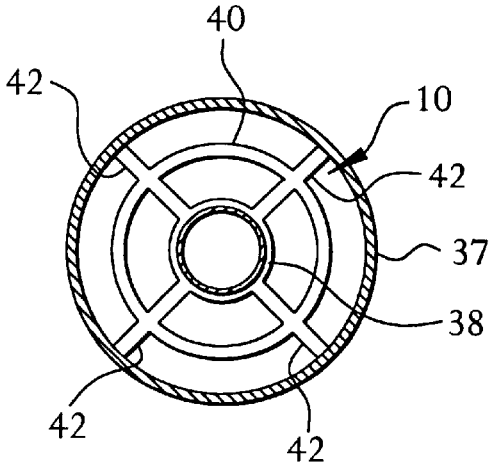
FIG. 2A is a view of the purifying agent barrier taken along the line A—A of FIG. 2.
Figure 2B:
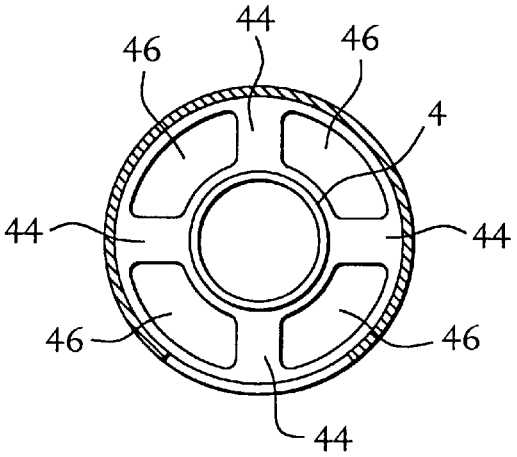
FIG. 2B is a view of the spacer between the concentric tubes of the cigarette holder taken along the line B—B of FIG. 2.
Figure 2C:
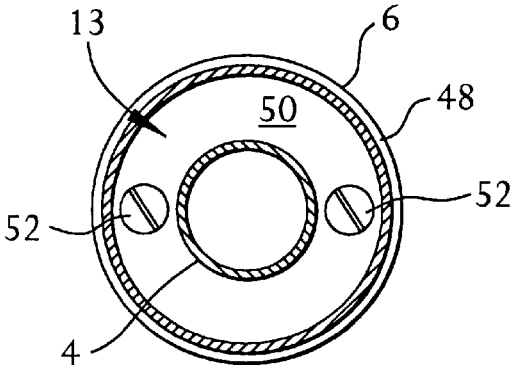
FIG. 2C is a view of the filler cap cover taken along the line C—C of FIG. 2.
Figure 2:
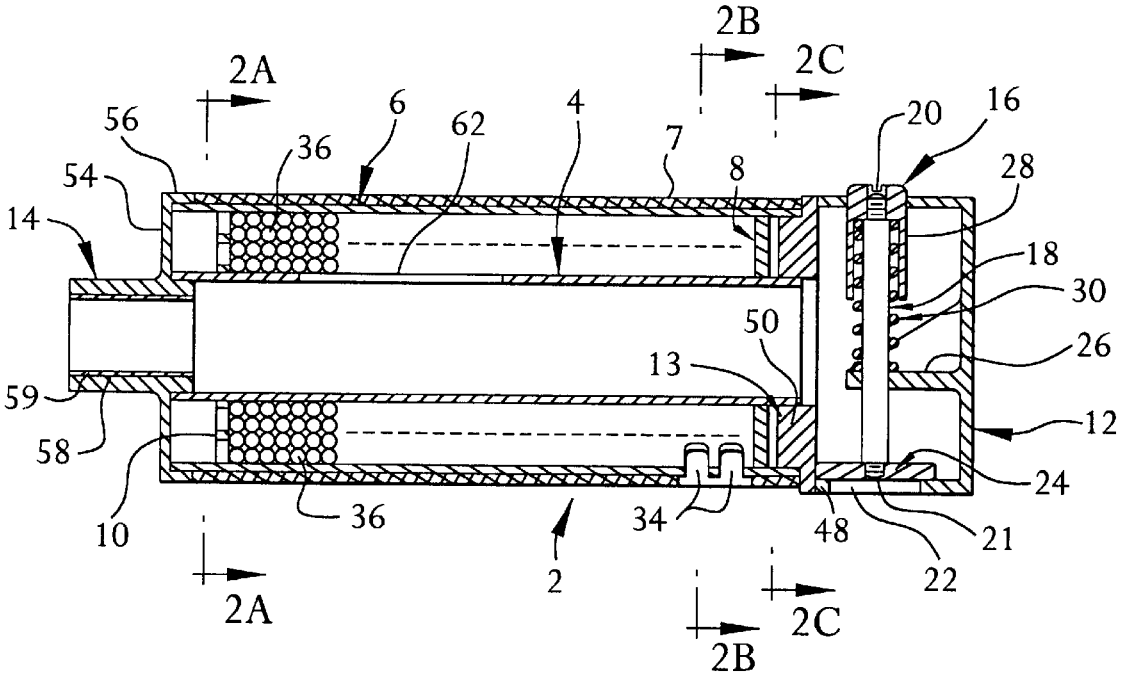
FIG. 2 is a longitudinal sectional view of the cigarette holder taken along the line A—A of FIG. 1.
Figure 3:
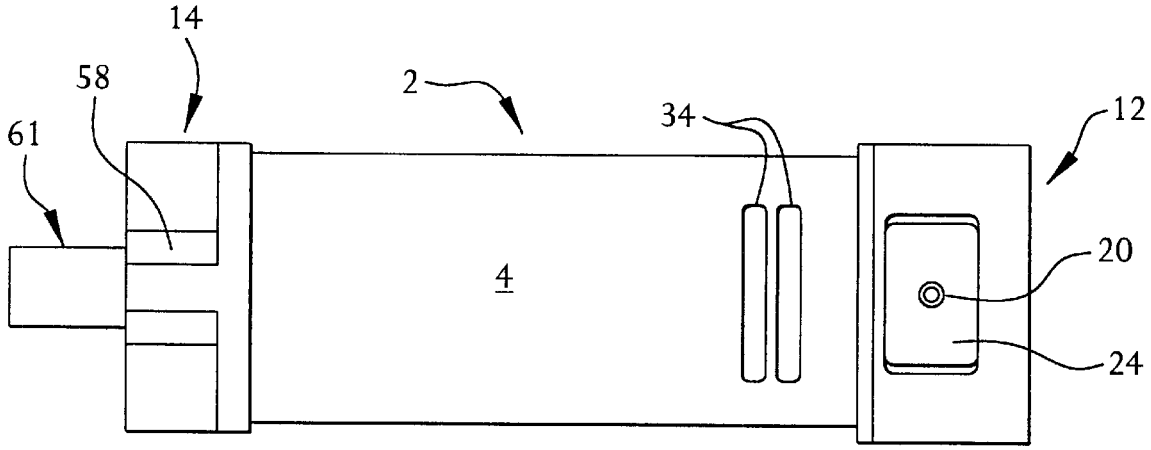
FIG. 3 is a side view of the cigarette holder.

Referring now in greater detail to the various figures of the drawings, wherein like reference characters refer to like parts, there is shown in FIGS. 1–3 the cigarette holder of the instant invention. Cigarette holder 2 comprises an inner tube 4, an outer tube 6 concentric with the inner tube 4, a filler cap 12 positioned at one end of the tubes, a mouthpiece 14 positioned at the other end of the tubes, a spacer 8 positioned between the inner and outer tubes 4 and 6 at the filler cap 12 end of the tubes, and a barrier 10 positioned in the area between the tubes 4 and 6 at the mouthpiece 14 end of the tubes.

The filler cap 12 has a plunger 16 which comprises a shaft 18, a cylindrical top 20, and a compression spring 30. The filler cap 12 also has a shelf 26 with a hole therein through which shaft 18 extends, and an air port 22. The plunger also includes an air port cover 24 attached to the shaft 18 by its threaded end 21.

In addition, as will be described later, the periphery of the inner tube 4 has a series of slots 62 to allow for cigarette smoke flow between the inner tube 4 and the volume between the inner tube 4 and the outer tube 6. Also, the outer tube 6 has slots 34 which allow for the exhaust of exhaled or mainstream smoke, as will be explained later.

The compression spring 30 is placed between a cylindrical top 28 and the shelf 26. The plunger 16 is operated to close the air port 22 when the smoker exhales as will be explained later.

A heat resistant cover 7 is placed on the outer periphery of the outer tube 6 to reduce the heat to the smoker when the cigarette holder 2 is held. The heat resistant cover 7 may be made from felt, simulated leather, or from any other suitable material.

Referring now to FIG. 2A, the barrier 10 comprises an outer ring 37, an inner ring 38, a center ring 40 and spokes 42. It serves to contain the purifying material, and to provide an air passage for the sidestream smoke when a lit cigarette is placed in the holder.

The spacer 8 is shown in FIG. 2B. The spacer 8 comprises radials 44 and openings 46. When it is desired to place a purifying agent into the device, the filler cap 12 is removed and the purifying agent 36, which can be activated carbon, is poured through the openings 46 into the device. The filler cap 12 is then replaced on the holder 2. Similarly, spent purifying agent 36 can be removed from the holder.

An end view of the filler cap cover 13 is shown in FIG. 2C. The filler cap cover 13 comprises a wall 50 having a lip 48. It also has two screws 52 for attaching the filler cap cover 13 to the filler cap. The structure of the filler cap 12 with regard to the attachment of the filler cap cover 13 will be described later with the aid of FIGS. 4 and 4A.

An end view of the mouthpiece 14 is shown in FIG. 1. The mouthpiece 14 comprises a bottom wall 54, to which is attached a lip 56 which contacts the outer surface of outer tube 6. Further, the mouthpiece 14 has a projecting wall 58 having an inner stainless steel liner 59. As shown in FIG. 3, the filter tip of a cigarette 61 projects through the opening 63 of the mouthpiece 14. Within the projecting wall 58, alongside the opening 63, are two channels 60 through which the smoker exhales smoke into the cigarette holder 2. The outer tube 6 also has slots 34 which allow exhaled smoke to exit the cigarette holder 2 after the smoke has passed through the purifying agent 36.

Figure 4:
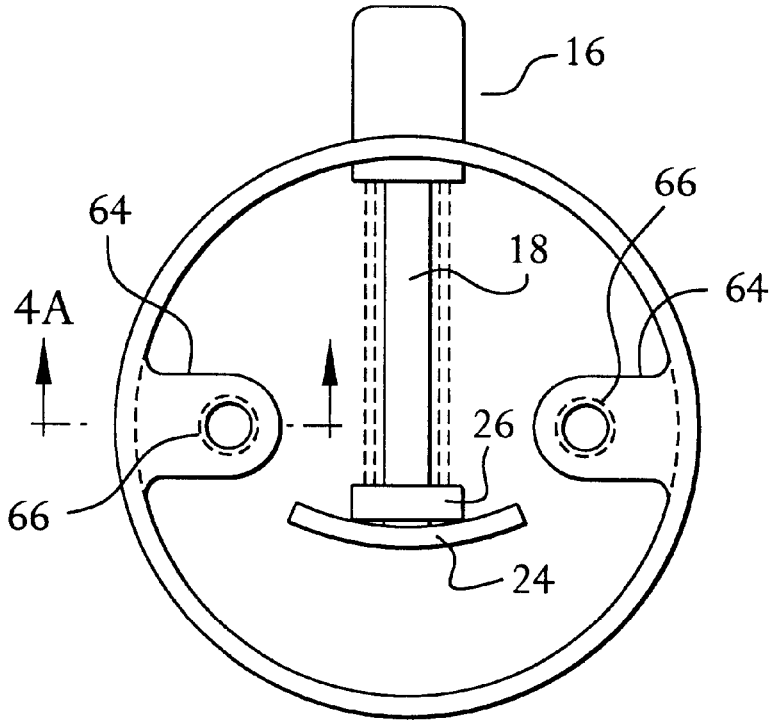
FIG. 4 is a end view of the filler cap with the cover removed.
Figure 4A:
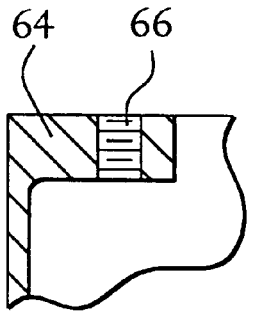
FIG. 4A is a view of the tapped hole of the filler cap for attaching the filter cap cover, taken along the line A—A of FIG. 4.

The means for attaching the filler cap cover 13 to the filler cap 12 is shown in FIGS. 4 and 4A. The filler cap 12 has two tabs 64 which comprise tapped holes 66. When the cover 12 is placed on the filler cap 12, screws 52 (FIG. 2C) are screwed into the tapped holes 66 to attach the cover.

Figure 5A:
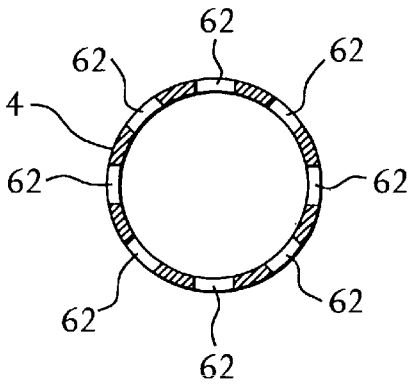
FIG. 5A is a sectional view of the inner tube of the cigarette holder taken along the taken along the line A—A of FIG. 5.
Figure 5:
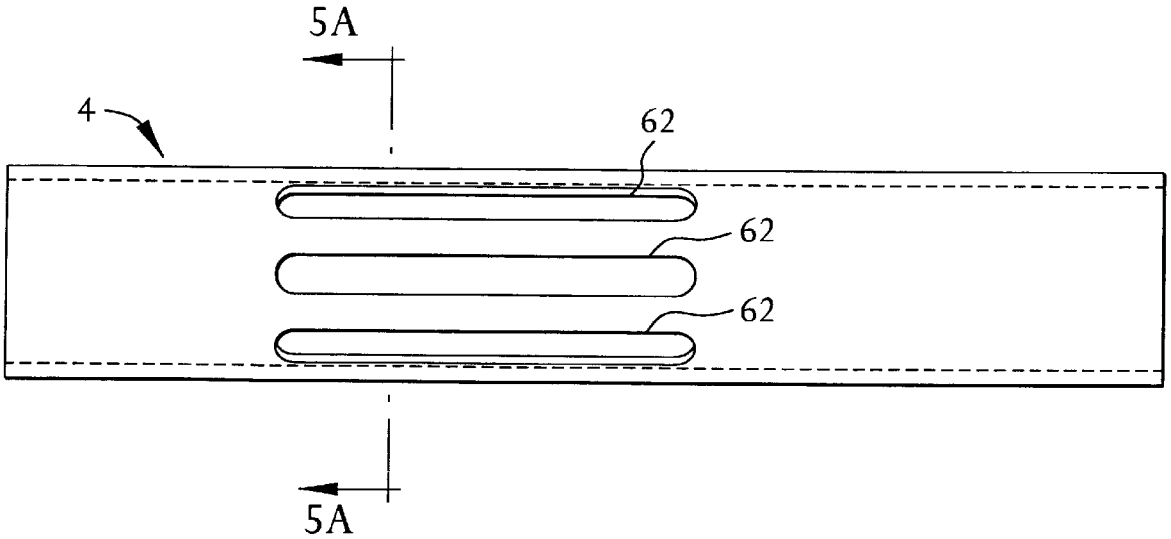
FIG. 5 is a side view of the inner tube of the cigarette holder.

Referring now to FIGS. 5 and 5A, the inner tube 4 has slots 62 which allow side stream smoke to enter the volume between the inner tube 4 and the outer tube 6. When a lit cigarette is placed within the inner tube 4, a "chimney effect" takes place, wherein fresh air enters through air port 22 into inner tube 4, sidestream smoke flows out through the slots 62 through the purifying agent 36 and out through channels 60 in the mouthpiece 14. Thus the lit tip of the cigarette gets plenty of fresh air allowing the cigarette to remain lit, while it is smoked.

The cigarette holder 2 is used as follows: The cigarette is lit and is placed through hole 63 into the cigarette holder 2 so that the lit end of the cigarette is adjacent to the filler cap cover 13. To exhale, the smoker places his or her lips over the mouthpiece, depresses the plunger 16 allowing the air port cover 24 to cover the air port 22. The exhaled smoke enters through exhaled channels 60 and then through the barrier 10 into the area between the inner tube 4 and the outer tube 6 where the purifying agent 36 is placed. The smoke then flows through the purifying agent and out through the slots 34. Thus, the same purifying agent 36 is used to purify both the sidestream smoke and the mainstream smoke except that the flow of the mainstream smoke is in the direction opposite to the flow of the sidestream smoke.

The smoker continues inhaling through the filter tip of the cigarette 61 and exhaling through the channels 60, while depressing the plunger 16.

Maintenance and servicing of the cigarette holder 2 is quite easy. As stated previously, the filler cap 12 is removed and the area between the inner tube 4 and the outer tube 6 is filled with purifying agent 36 (preferably activated carbon) by pouring it through the openings 46 in the spacer 8. The activated carbon will be poured up to and be stopped by the barrier 10. The area between the inner tube 4 and the outer tube 6 is quite large, so that a large amount of activated carbon can be used.

When the activated carbon is spent, i.e., its purification action has decreased due to the smoking of many cigarettes, the filler cap 12 is removed, the spent purifying agent is poured out through the openings 46 of the spacer 8, and fresh activated carbon is inserted into the cigarette holder 2.

Activated carbon has been used for many years as a purifying agent for liquids and gases in industrial processes. It has also been used to remove toxins and/or carcinogenic material from cigarette smoke by placing small amounts in cigarette filter tips. This usage, however, does not remove any toxins from sidestream smoke, nor does it purify mainstream smoke. Its use in the cigarette holder of this invention, in this way, is novel. The preferred purifying agent of this invention is activated carbon in pellet form. Each pellet is 15 inches in diameter. Each pellet has thousands of holes whose diameters are several millionths of and inch. The totally exposed area in each pellet is hundreds of square feet. When molecules of the toxic gases in the cigarette smoke enter these holes the carbon draws them in, much as a blotter soaks in wet ink. This process is called adsorption. Carbon is a very effective adsorption agent and in this invention it removes a significant amount of toxic and carcinogenic gases from the sidestream and mainstream cigarette smoke.

The cigarette holder 2 has been tested by various smokers. They have found that the smoking experience is similar to smoking a cigarette without the holder. The taste is not altered. However the amount of smoke, odor and toxic gases emitted to the environment is considerably reduced. Furthermore, the cigarette holder 2 is simple in that no forced air with attendant power source is required because the "chimney effect" provides for ample qualities of air to the lit cigarette.

In summary, the cigarette holder purifies both mainstream and sidestream smoke. The design of the cigarette holder 2 also permits a large amount of purifying agent (activated carbon) which is light in weight. Since the holder completely encloses the lit cigarette, it eliminates fires, burns and damage to clothing, furniture, rugs and so forth. It also eliminates lingering household odors and clothing odors and prevents the discoloring of the fingers of the smoker.

Without further elaboration, the foregoing will so fully illustrate my invention, that others may, by applying current or future knowledge readily adapt the same for use under the various conditions of service.

I claim:

1. A cigarette holder for purifying side stream and mainstream smoke from a cigarette comprising means for passing the side stream smoke through a purifying agent in one direction and for passing mainstream smoke through the same purifying agent in the opposite direction, said means comprising:

(a) Two tubes, an inner tube and an outer tube concentric with said inner tube;

(b) A purifying agent placed in the volume between said concentric inner and outer tubes;

(c) A removable mouthpiece located at a first end of said concentric tubes for holding the filter tip of the cigarette, said mouthpiece comprising a first center hole through which the filter tip of the cigarette protrudes and at least one opening through which the mainstream cigarette smoke is exhaled;

(d) a filler cap located at a second end of said concentric tubes, said cap being removable for placing said purifying agent into said volume and for replacing said purifying agent when it is spent, said cap comprising an air port for allowing air to enter into said inner tube to maintain the combustion of the cigarette when it is lit and placed into said inner tube and comprising means for manually closing said air port with the cigarette placed through said first center hole into the inner space of said inner tube, and the lit end of the cigarette adjacent said filler cap;

(e) said inner tube comprising first slots for passing the side stream smoke from said inner tube to said outer tube and said outer tube comprising second slots for passing the mainstream smoke from said cigarette holder to the environment; and further comprising a spacer at said second end of said concentric tubes positioned within said outer tube with a second center hole for positioning said inner tube relative to said outer tube and a purifying agent barrier positioned at said first end having a third center hole for positioning said inner tube relative to said outer tube; and wherein said filler cap further comprises a filler cap cover and said filler cap has a pair of inwardly projecting tabs with tapped holes for attaching said cover to said filler cap.

2. The cigarette holder of claim 1 wherein said means for manually closing said air port comprises said filler cap with a manually operable plunger having an air port cover, for covering said air port when mainstream smoke is exhaled into said cigarette holder.

3. The cigarette holder of claim 2 wherein said filler cap comprises an end wall having an inwardly projecting shelf with a second opening therein, through which said plunger slides, a plunger cap and a compression spring, positioned between said plunger cap and said shelf, so that said plunger is normally positioned with said air port open and when said plunger is depressed, opposed to said compression spring, the air port is closed.

4. The cigarette holder of claim 3 wherein said spacer has a set of third openings through which said purifying material may be placed into said volume between said inner and said outer tubes.

5. The cigarette holder of claim 4 wherein said purifying agent barrier comprises an outer ring, a center ring and an inner ring with radials between said rings to provide spaces through which the sidestream smoke can flow out of the said outer tube after purification by said purifying agent said spaces being narrow enough to prevent said purifying agent from passing through.

6. The cigarette holder of claim 5 wherein said first center hole in said mouthpiece comprises a stainless steel lining.

7. The cigarette holder of claim 6 further comprising a heat resistant material which covers the outer surface of said outer tube.

8. The cigarette holder of claim 7 wherein said purifying agent comprises activated carbon in pellet form.

9. A cigarette holder for purifying side stream and mainstream smoke from a cigarette comprising means for passing the side stream smoke through a purifying agent in one direction and for passing mainstream smoke through the same purifying agent in the opposite direction, said means comprising:

(a) Two tubes, an inner tube and an outer tube concentric with said inner tube;

(b) A purifying agent placed in the volume between said concentric inner and outer tubes;

(c) A removable mouthpiece located at a first end of said concentric tubes for holding the filter tip of the cigarette, said mouthpiece comprising a first center hole through which the filter tip of the cigarette protrudes and at least one opening through which the mainstream cigarette smoke is exhaled;

(d) a filler cap located at a second end of said concentric tubes, said cap being removable for placing said purifying agent into said volume and for replacing said purifying agent when it is spent, said cap comprising an air port for allowing air to enter into said inner tube to maintain the combustion of the cigarette when it is lit and placed into said inner tube and comprising means for manually closing said air port, with the cigarette placed through said first enter hole into the inner space of said inner tube, and the lit end of the cigarette adjacent said filler cap;

(e) said inner tube comprising first slots for passing the side stream smoke from said inner tube to said outer tube and said outer tube comprising second slots for passing the mainstream smoke from said cigarette holder to the environment and further comprising a spacer at said second end of said concentric tubes positioned within said outer tube with a second center hole for positioning said inner tube relative to said outer tube and a purifying agent barrier positioned at said first end having a third center hole for positioning said inner tube relative to said outer tube wherein said filler cap further comprises a filler cap cover and said filler cap has a pair of inwardly projecting tabs with tapped holes for attaching said cover to said filler cap; and wherein said purifying agent comprises activated carbon.

10. The cigarette holder of claim 9 wherein said means for manually closing said air port comprises said filler cap with a manually operable plunger having an air port cover, for covering said air port when mainstream smoke is exhaled into said cigarette holder.

11. The cigarette holder of claim 10 wherein said filler cap comprises an end wall having an inwardly projecting shelf with a second opening therein, through which said plunger slides, a plunger cap and a compression spring, positioned between said plunger cap and said shelf, so that said plunger is normally positioned with said air port open and when said plunger is depressed, opposed to said compression spring, the air port is closed.

12. The cigarette holder of claim 11 wherein said spacer has a set of third openings through which said purifying material may be placed into said volume between said inner and said outer tubes.

13. The cigarette holder of claim 12 wherein said purifying agent barrier comprises an outer ring, a center ring and an inner ring with radials between said rings to provide spaces through which the sidestream smoke can flow out of the said outer tube after purification by said purifying agent, said spaces being narrow enough to prevent said purifying agent from passing through.

14. The cigarette holder of claim 13 wherein said first center hole in said mouthpiece comprises a stainless steel lining.

15. The cigarette holder of claim 14 further comprising a heat resistant material which covers the outer surface of said outer tube.

* * * * *